United States Patent [19]

Takei et al.

[11] 4,450,218

[45] May 22, 1984

[54] PHOTOCONDUCTIVE RECEPTOR FOR AN ELECTROPHOTOGRAPHY

[75] Inventors: Yoshiaki Takei; Yoshihide Fujimaki; Hiroyuki Nomori, all of Hachioji, Japan

[73] Assignee: Konishiroku Photo Industry Co., Ltd., Tokyo, Japan

[21] Appl. No.: 421,489

[22] Filed: Sep. 22, 1982

[30] Foreign Application Priority Data

Oct. 1, 1981 [JP] Japan ..... 56-157096

[51] Int. Cl.[3] ..... G03G 5/14

[52] U.S. Cl. ..... 430/59

[58] Field of Search ..... 430/58, 59

[56] References Cited

U.S. PATENT DOCUMENTS

| | | | |
|---|---|---|---|
| 4,346,157 | 8/1982 | Kakuta et al. | 430/59 X |
| 4,349,617 | 9/1982 | Kawashiri et al. | 430/58 X |
| 4,361,638 | 11/1982 | Higashi et al. | 430/58 |
| 4,363,859 | 12/1982 | Sasaki et al. | 430/59 |

*Primary Examiner*—Roland E. Martin, Jr.

*Attorney, Agent, or Firm*—Frishauf, Holtz, Goodman & Woodward

[57] ABSTRACT

An electrophotographic element having a carrier generating layer and a carrier transport layer, which carrier transport layer contains an arylamine derivative and an amine substituted styryl compound, is disclosed.

14 Claims, 4 Drawing Figures

PHOTOCONDUCTIVE RECEPTOR FOR AN ELECTROPHOTOGRAPHY

BACKGROUND OF THE INVENTION

The present invention relates to a photoconductive receptor for electrophotography, and more particularly to those having a carrier transport layer which is to be combined with a layer comprising a substance capable of generating a carrier upon the absorption of light.

Recently, in the electrophotographic field, there has been proposed that a photoconductive receptor having a photoconductive layer is constituted by combining a carrier generating layer with a carrier transport layer, the former comprises a substance capable of generating charged carriers upon the absorption of a visible ray of light and the latter is capable of transporting one or both of the positive and negative charged carriers which were generated in the carrier generating layer.

Like this proposal, when the generation of charged carriers and the transportation thereof, that is, the two fundamental functions of a photosensitive layer are separately assigned respectively to different substances or different systems of materials with each other, it becomes possible to widen the applicable range of the substances for constituting a photoconductive layer and besides to select independently the substances or systems of materials capable of most suitably performing each of the functions, and that is then the case, it is further possible to constitute a photoconductive layer excellent in the various characteristics required for an electrophotographic process, for example, the characteristics such as that the surface potential is high when charged, the charge holding property is great, the surface hardness is excellent, the photosensitivity is high, the stability is excellent in a repeating use.

As for the photoconductive layers like the above, there are given the following ones which have so far been known:

(1) A photoconductive layer laminated a carrier generating layer comprising an amorphous selenium or a cadmium sulfate with a carrier transport layer comprising a poly-N-vinyl carbazole.

(2) A photoconductive layer laminated a carrier generating layer comprising an amorphous selenium or a cadmium sulfate with a carrier transport layer comprising 2,4,7-trinitro-9-fluorenone.

(3) A photoconductive layer laminated a carrier generating layer comprising a perylene derivative with a carrier transport layer containing an oxadiazole derivative (refer to U.S. Pat. No. 3,871,882).

(4) A photosensitive layer laminated a carrier generating layer comprising Chloro Diane Blue or Methyl Squarylium with a carrier transport layer comprising a pyrazoline derivative (refer to Japanese Patent Publication Open to Public Inspection No. 90827/1976).

(5) A photoconductive layer laminated a carrier generating layer comprising an amorphous selenium or the alloy thereof with a carrier transport layer comprising a polyaryl alkane aromatic amino compound (refer to Japanese Patent Publication Open to Public Inspection No. 142751/1977).

(6) A photoconductive layer laminated a carrier generating layer comprising a perylene derivative with a carrier transport layer comprising a polyaryl alkane aromatic amino compound (refer to Japanese Patent Application No. 19907/1978).

As given above there have been known many kinds of the photoconductive layers, but most of the conventional receptors having these kinds of the photoconductive layers have such a defect that the lifetime thereof is extremely short because the electrical fatigue of the photoconductive layer becomes serious when the receptor is applied repeatedly to electrophotographic process. To be more concrete, whenever an electrophotographic process is completed and the next process is to be started, it is required to neutralize the charge on the photoconductive layer being processed. But, on the contrary, it is impossible to neutralize such a charge completely even if the neutralization is tried by, for example, exposing to a large amount of light, because the discharge from this kind of photoconductive layers is very slow at the final discharging stage, therefore, there still remains a considerably high residual potential and moreover the potential is accumulatively increased every time when the electrophotographic process is repeated, and the residual potential exceeds the limits allowed, (in a low frequency of continuous copying), and consequently the photoconductive receptor will get into difficulties to be used.

For all that, in some kind of photoconductive receptors, it is possible to restore it to the usable condition again, but it is still necessary to put it in the quiescent state for a considerably long time to recover the performance, or to apply a suitable heat treatment. Nevertheless, it is hardly possible to recover the residual potential to such a level as is sufficiently low, therefore, there sharply decreases the continuous copying times to be practically possibel until the receptor becomes unusable again. To cope therewith, there have been proposed such a method as that, for example, in an photoconductive receptor in which a carrier transport substance having an electron donating property is used and is combined with a carrier generating substance, a very small amount of a Lewis acid is added into a layer containing the carrier transport substance as a method for preventing the photoconductive receptor from accumulating the residual potential thereof and also for improving the repetition characteristics. But, it is good method, to be sure, for the photoconductive receptors using a specified electron donative carrier transport substance, but it is hard to effectively prevent satisfactorily from accumulating residual potential in a photoconductive receptor using many of the other electron donative carrier transport substances.

SUMMARY OF THE INVENTION

It is an object of the present invention to provide a photoconductive receptor for an electrophotography in which the defects as mentioned above are eliminated and any fatigue and deterioration are caused less in the repeating operation and the long lifetime thereof can be maintained for a long and continuous performance.

It is another object of the present invention to provide a photoconductive receptor for an electrophotography improved the deterioration of the characteristics in the continuous usage of the photoconductive receptor comprising a carrier generating layer and a carrier transport layer.

It is still another object of the present invention to provide a photoconductive receptor for an electrophotography improved the stability of the photoconductive receptor using an amine derivative to serve as a carrier transport substance held in a carrier transport layer, the stability thereof is against the active products such as ozone and ultra-violet ray, and is also to improve the deterioration of the characteristics caused in a continuous running.

Our inventors have devoted themselves into the serious studies to achieve the above objects, and have thus accomplished the invention.

The objects of the present invention can be achieved by that, in a photoconductive receptor for an electrophotography being provided on the conductive support thereof with a photoconductive layer comprising a carrier generating layer and a carrier transport layer, the photoconductive receptor characterized in that said photoconductive layer comprises an amine derivative represented by a following Formula [A] and a styryl compound represented by a following formula [B] as a carrier transport substance:

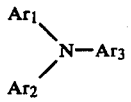

Formula [A]

wherein, $Ar_1$ and $Ar_2$ each represent a phenyl group which may have a substituent or substituents selected from the group consisting of a halogen, an alkyl group, a nitro group and an alkoxy group, and $Ar_3$ represents a phenyl group, a naphthyl group, an anthryl group, a fluorenyl group or a heterocyclic ring, said groups and ring may have a substituent or substituents selected from the group consisting of a halogen, an alkyl group, a hydroxy group, an alkoxy group, an aryloxy group, a nitro group, a piperidino group, a morpholino group, a naphthyl group, an anthryl group and a substituted amino group which may have a substituent or substituents selected from the group consisting of an acyl group, an alkyl group, an aryl group and an aralkyl group.

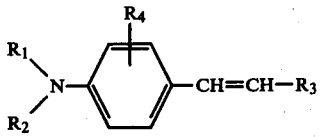

Formula [B]

wherein, $R_1$ and $R_2$ each represent an alkyl group or a phenyl group, said groups may have a substituent or substituents selected from the group consisting of an alkyl group, an alkoxy group and a phenyl group; $R_3$ represents a phenyl group, a naphthyl group, an anthryl group, a fluorenyl group or a heterocyclic ring, said groups and ring may a substituent or substituents selected from the group consisting of a halogen, a hydroxy group, an alkyl group, an alkoxy group and a phenyl group; and $R_4$ represents a hydrogen, a halogen, an alkyl group, an alkoxy group or mono- or di-alkyl amino group.

DETAILED DESCRIPTION OF THE PREFERRED EMBODIMENTS

A carbon number of above all alkyl groups is optional, and preferable carbon number of said groups is 1–12, and the above halogen is a chlorine or a bromine, preferably. The heterocyclic ring in the formula [A] is preferable 5–7 membered ring and a most preferable ring is a furyl group or a thienyl group, and the heterocyclic ring in the formula [B] is preferable 5–7 membered ring and a most preferable ring is a carbazolyl group.

The following are the concrete and typical examples of an amine derivative formulized in the aforegiven Formula [A], that is useful in the invention:

(A-1)

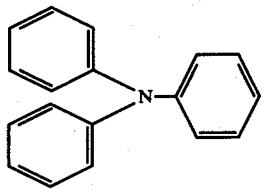

(A-2)

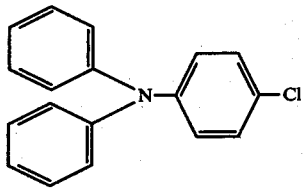

(A-3)

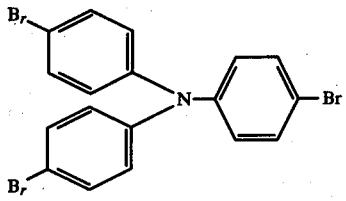

(A-4)

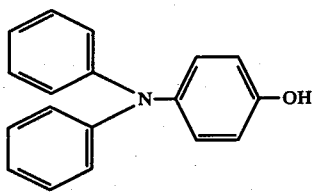

(A-5)

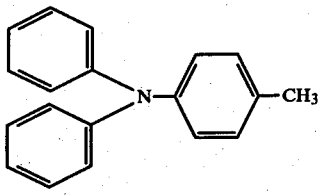

-continued
(A-6)
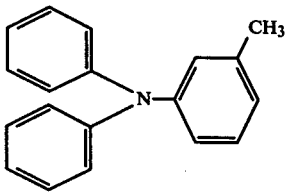
(A-7)
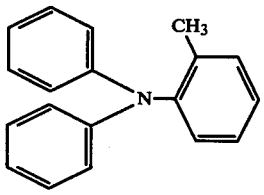
(A-8)
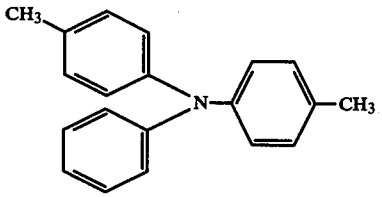
(A-9)
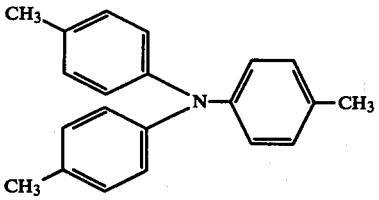
(A-10)
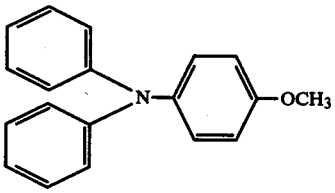
(A-11)
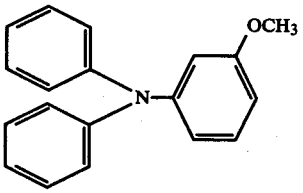
(A-12)
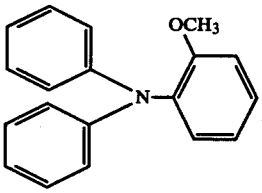
-continued
(A-13)
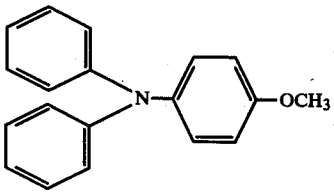
(A-14)
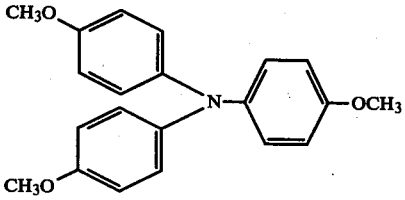
(A-15)
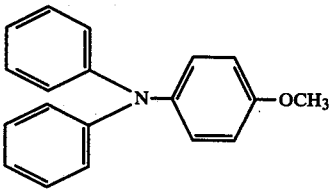
(A-16)
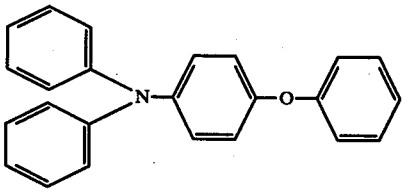
(A-17)
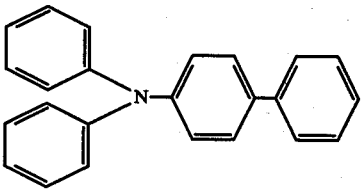
(A-18)
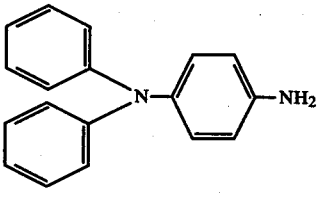
(A-19)
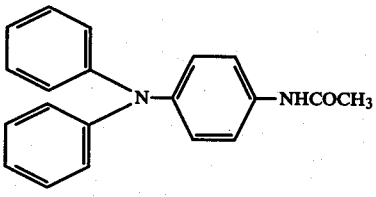

-continued
(A-20)
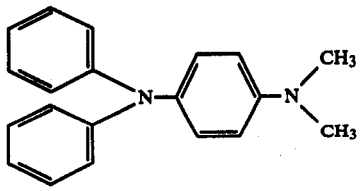
(A-21)
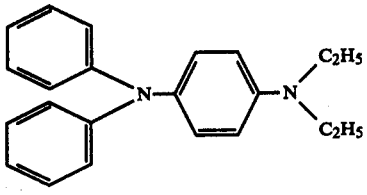
(A-22)
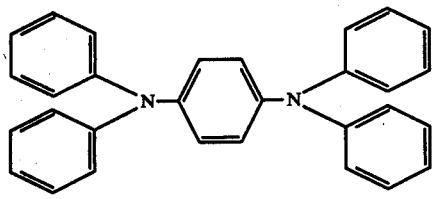
(A-23)
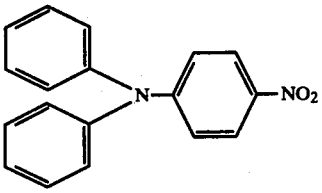
(A-24)
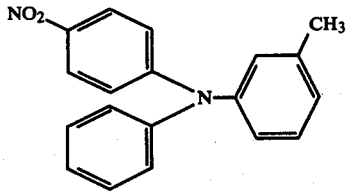
(A-25)
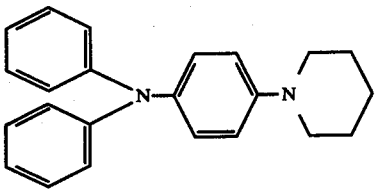
(A-26)
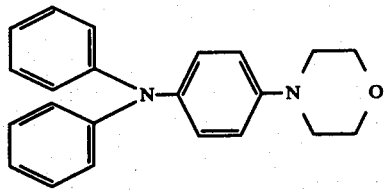
-continued
(A-27)
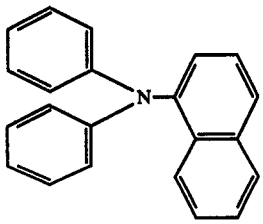
(A-28)
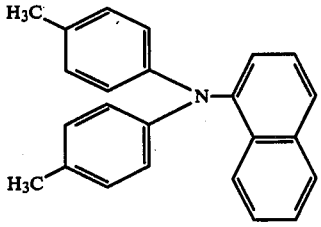
(A-29)
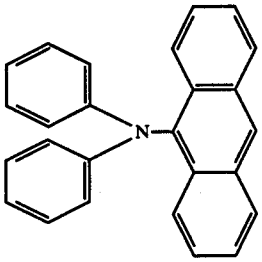
(A-30)
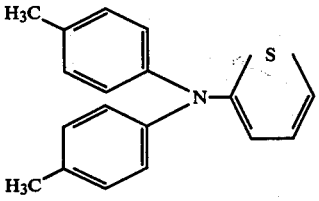
(A-31)
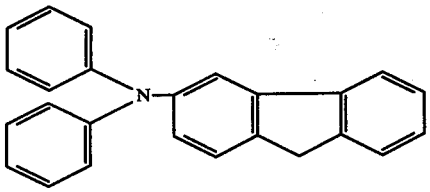
(A-32)
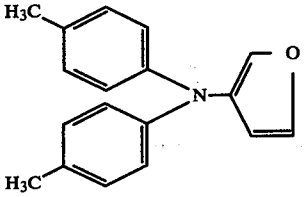
(A-33)
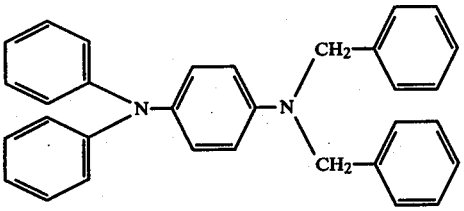

The following are given as the concrete and typical examples of a styryl compound formularized in Formula [B], that is useful in the invention:
(B-1)
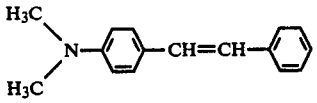
(B-2)
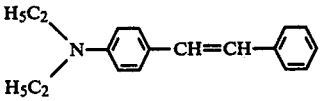
(B-3)
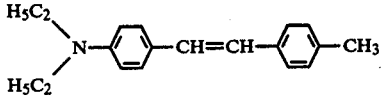
(B-4)
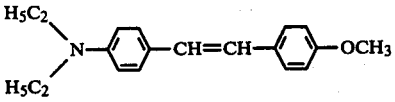
(B-5)
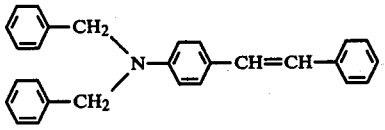
(B-6)
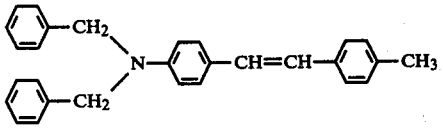
(B-7)
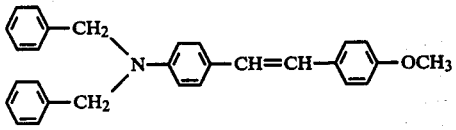
(B-8)
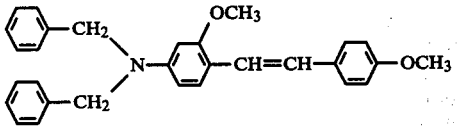
(B-9)
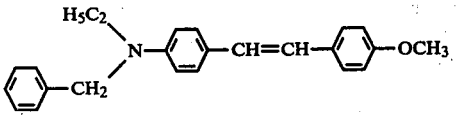
(B-10)
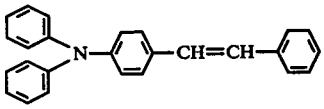
(B-11)
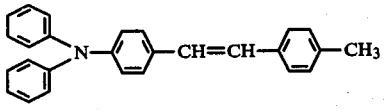
(B-12)
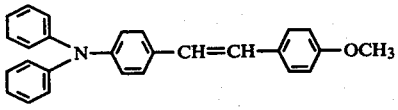
-continued
(B-13)
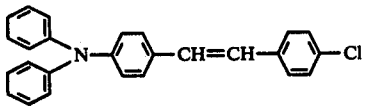
(B-14)
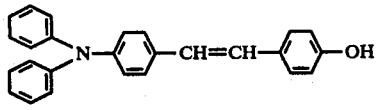
(B-15)
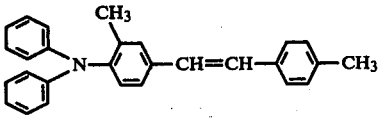
(B-16)
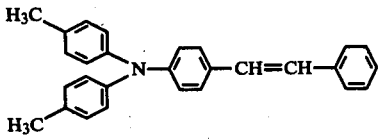
(B-17)
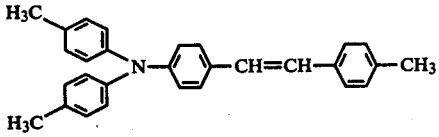
(B-18)
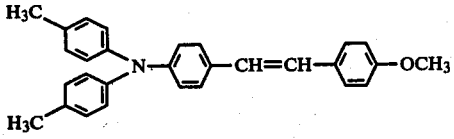
(B-19)
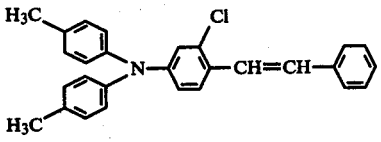
(B-20)
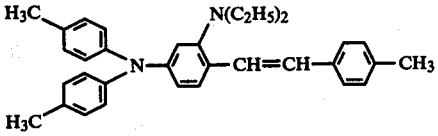
(B-21)
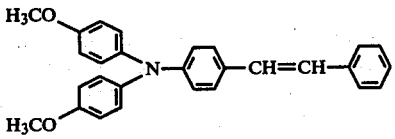
(B-22)
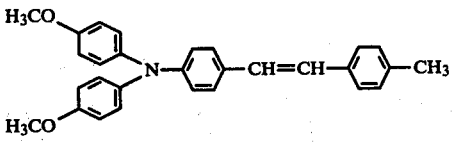
(B-23)
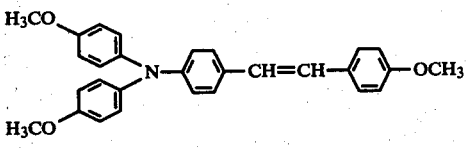

-continued (B-24)

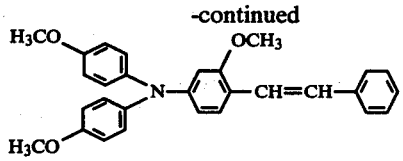

(B-25)

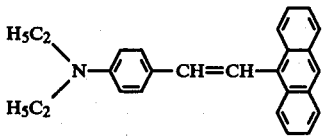

(B-26)

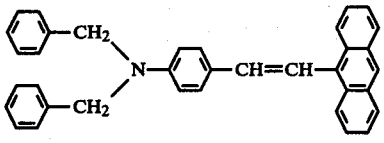

(B-27)

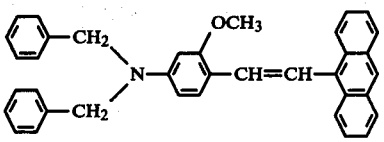

(B-28)

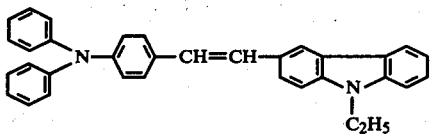

(B-29)

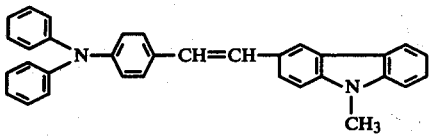

(B-30)

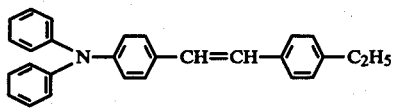

(B-31)

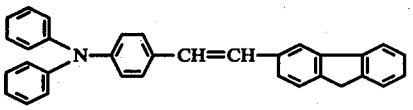

It is to be understood that the compounds relating to the present invention shall not be limited to the above-given concrete examples thereof. The present invention shall be attained by making use of such an amine deerivative as formulized in Formula [A] and such a styryl compound as formulized in Formula [B] in combination with each other.

The present invention will be concretely described with reference to the drawings.

Figure 1:
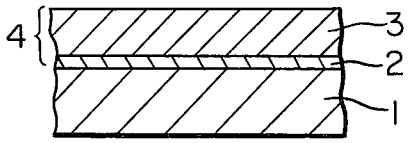
FIG. 1 is an illustrative enlarged sectional view of one example of a photoconductive receptor constructions of the present invention.

In the present invention, as shown in FIG. 1, a carrier generating layer 2 is formed on a conductive support 1 so that the generating layer 2 comprises a carrier generating substance as the principal component thereof and a carrier transport layer 3 is formed lamationwise on the carrier generating layer 2 so that the transport layer 3 comprises the above-mentioned carrier transport substance of the present invention as the principal component thereof, and a photosensitive layer 4 is thus constituted with the carrier generating layer 2 and the carrier transport layer 3.

Figure 2:
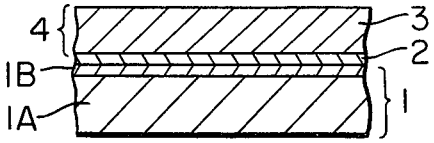
FIG. 2 is an illustrative enlarged sectional view of the other construction example of the photoconductive receptor of the present invention.

In this case, as for the materials of the conductive support, a metal sheet made of, for example, aluminium, nickel, copper, zinc, palladium, silver, indium, tin, platinum, gold, stainless steel or brass may be used, and the support shall not be limited thereto. For example, as shown in FIG. 2, it is also possible to constitute the conductive support 1 by providing with a conductive layer 1B on a insulating substrate 1A.

As for the substrate 1A to be used in this case, an inflammable substrate such as a paper or a plastic sheet having sufficient strength against such a stress as bending and tension, are suitable. The conductive layer 1B may be provided by laminating with a metal sheet, by vacuum-evaporating with a metal on the insulating substrate 1A, or by making use of some other method.

The aforementioned carrier generating layer 2 may be formed with only a carrier generating substance that will be described layer, or with a binder and the carrier generating substance therein dispersed, or with the latter to which a substance having a high mobility to a carrier, i.e., a carrier transport substance, is further added.

As for the concrete methods for forming thereof, there may be given those methods such as the one in which a carrier generating substance is vacuum-evaporated over the aforementioned support and another one in which a carrier generating substance is dissolved or dispersed in a suitable solvent and then the solution thus obtained is coated on the support and is dried up.

In the latter method, a binder or a carrier transport substance may be added, and when this is the case it is preferable that the proportion of a carrier generating substance: a binder resin: a carrier transport substance is 1:0–100:0–500 by weight, and is more preferably 1:0–10:0–50 by weight.

As for the carrier generating substance, anyone of an inorganic pigment and an organic dye may be used provided that such substance is capable of absorbing a visible ray of light and of generating a free-carrier.

In addition to such an inorganic pigment as an amorphous selenium, a trigonal system selenium, selenium-arsenic alloy, selenium-tellurium alloy, cadmium sulfide, cadmium selenide, cadmium sulfur selenide, mercuryl selenide, lead oxide and lead sulfide, the organic dyes exemplified as the following typical examples may be used:

(1) an azo dye such as monoazo dye, polyazo dye, metal-complex salt azo dye, pyrazolone azo dye, stilbene azo dye and thiazole azo dye,
(2) a perylene dye such as perylene anhydride and perylenic imide,
(3) an anthraquinone or a heterocyclic quinone dye such as an anthraquinone derivative, an anthoanthrone derivative, a dibenzpyrenequinone derivative, a pyranthrone derivative, a violanthrone derivative and an isoviolanthrone derivative,
(4) an indigoid dye such as an indigo derivative and a thioindigo derivative,
(5) a phthalocyanine dye such as a metal phthalocyanine and a non-metal phthalocyanine,
(6) a carbonium dye such as diphenyl methane dye, triphenyl methane dye, xanthene dye and acridine dye, (7) a quinoneimine dye such as azine dye, oxazine dye and thiazine dye,
(8) a methine dye such as cyanine dye and azomethine dye,
(9) a quinoline dye,
(10) a nitro dye,
(11) a nitroso dye,
(12) a benzoquinone dye and a naphthoquinone dye,
(13) a naphthalimide dye,
(14) a perynone dye such as a bisbenzimidazole derivative, and,
(15) a quinacridone dye.

As a binder usable for the carrier transport layer, an addition polymerization type resin, a polyaddition polymerization type resin, a polycondensation type resin such as, for example, polyethylene, polypropylene, polyacrylates, polymethacrylates, polyvinyl chlorides, polyvinyl acetates, epoxy resin, polyurethanes, phenolic resin, polyesters, alkyd resin, polycarbonates, slicone resin and melamine resin etc., and a copolymer resin containing two or more of repetition units of these resins such as vinyl chloride-vinyl acetate copolymer and vinyl chloride-vinyl acetate-maleic anhydride copolymer, these binder resins are of course usable, and an organic semiconductive polymer such as poly-N-vinyl carbazole is also usable. Further; these binders may also be used in the mixture system of two or more of the binder.

As a carrier transport substance that can be added to the carrier generating layer and has a high mobility for the carrier with a specific polarity or an unspecific polarity, a carrier transportable substance to be used for the constitution such as carrier transport layer 3 in the present invention can be used as a part of the whole thereof but other carrier transport substance may be used in due consideration of the performance as the photoconductive receptor.

Furthermore, it is possible to cause the carrier generating layer to contain single or plural kinds of an electron acceptable substance with the object of the improvement of the sensitivity and the reduction of the fatigue caused by residual potential or by repeated usage.

As the electron acceptable substance that can be used in this case, succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoqinodimethane, o-dinitrobenzene, p-dinitrobenzene, 1,3,5-trinitrobenzene, p-nitrobenzonitril, picrylchloride, quinonchlorimide, chloranyl, bromanil, dichlorodicyano-parabenzoquinone, anthraquinone, dinitroanthraquinone, 2,7-dinitrofluorenone, 2,4,7-trinitrofluorenone, 2,4,5,7-tetranitrofluorenone, 9-fluorenylidene[dicyanomethylenemalonodinitril], polynitro-9-fluorenylidene[dicyanomethylenemalonodinitril], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and other compounds with a big electron affinity are given. The ratio by weight for addition of electron acceptable substances is, carrier generating substance:electron acceptable substance=100:0.01–200 and preferably, carrier generating substance:electron acceptable substance=100:0–100.

The thickness of aforesaid carrier generating layer 2 formed in the aforesaid manner is preferably 0.005–20μ and 0.1–5μ is more preferable in particular.

Aforesaid carrier transport layer 3 can be formed by using the mixture of aforesaid amine derivative [A] and a styryl compound [B] as a carrier transport substance and, as occasion demands, by the method to coat and dry the coating liquid obtained by dissolving or dispersing together with an appropriate binder or by the other method.

Regarding the mixing ratio between the amine derivative [A] and a styryl compound [B], the ratio of the styryl compound [B] to the total carrier transport substance [A]+[B] is reasonably the range from 1 wt% to 80 wt% and the range from 5 wt% to 50 wt% is preferable in particular. When it is not more than 1 wt%, the rise of the residual potential for the repeated usage is excessive and thereby the desired stability for the repetition can not be obtained and while it is not less then 80 wt%, the drop of the charge potential for the repeated usage is remarkable and thereby the desired stability for the repetition can not also be obtained.

As a binder usable for the carrier transport layer, an addition polymerization type resin, a polyaddition polymerization type resin, a polycondensation type resin such as, for example, polyethylene, polypropylene, polyacrylates, polymethacrylates, polyvinyl halides resin, polyvinyl acetates, epoxy resins, polyurethanes, phenolic resins, polyester, alkyd resins, polycarbonates, silicone resins and melamine resins etc., and a copolymer resin containing two or more of repetition units of these resins such as vinyl chloride-vinyl acetate copolymer and vinyl chloride-vinyl acetate-maleic anhydride copolymer; these binders are of course usable, and an organic semiconductive polymer such as poly-N-vinyl carbazole is also usable. Further, these binders may also be used in the mixture system of two or more of the binder.

The mixing ratio between the binder and total carrier transport substance is preferably 100 parts by weight of the binder resin for 10–500 parts by weight of total carrier transport substance and when polycarbonates is used as a binder resin, 100 parts by weight thereof for 20–200 parts by weight of total carrier transport substance is preferable because it gives excellent characteristics for electrophotography.

Furthermore, it is possible to add aforesaid electron acceptable substance to the carrier transport layer with the purposes of the improvement in the sensitivity and of the reduction of residual potential or fatigue for the repeated usage. When the electron acceptable substance is added to the both layers of carrier generating layer and carrier transport layer, electron acceptable substance may either be entirely identical or partially identical or quite different in certain circumstances.

The ratio by weight for adding of electron acceptable substance to the carrier transport layer is 100:0.01–100 for total carrier transport substance: electron acceptable substance and it is preferably 100:0.1–50.

The thickness of the carrier transport layer thus formed is 2–100μ and it preferably is 5–30μ.

The photoconductive receptor for an electrophotography of the present invention has aforesaid constitution and as is clear from the examples and comparative examples mentioned later, electrical fatigue on the photoconductive layer is less even when it is used continuously for the electrophotographic process and residual potential that is unremovable on a photoconductive layer 4 does not increase accumulatively, thereby a long life for the usage thereof is obtained and at the same time, there is no restriction for the continuous copying and it is possible to form constantly and stably the copied images without a fog on their background.

The photoconductive receptor for an electrophotography of the present invention has a big stability for the deteriorating factors such as photochemical reactions based on the active light irradiated from an exposure lamp or a discharge lamp, oxidization action caused by active substance generated from a corona discharge and the rise of temperature in the machine etc. and has a small change with the passage of time in the characteristics such as acceptance potential in the light, sensitivity and residual potential etc., therefore the spontaneous deterioration caused by the usage thereof is less and the maintenance and handling for the photoconductive receptor are extremely simple. Further, in the aforesaid carrier transport layer 3, it is possible to cause it to contain the binder at a comparatively high concentration without detracting its good characteristics and by doing that it is possible to enhance the mechanical strength of the photoconductive layer 4, which leads to a big durability against the mechanical damage such as a durability for the development and a durability for the cleaning etc. and even from this aspect, the life for the usage is extended.

With aforementioned constitution of the carrier transport layer 3, the present invention has a distinctive feature that the photoconductive receptor of the present invention is capable of maintaining the stable performance especially for the continuous usage.

The reasons why the photoconductive receptor of the present invention shows its excellent specific character in this manner are not clear but are guessed to be that styryl compound that is an element of the carrier transport substance to be used together with carrier generating substance for the formation of the photoconductive layer of the photoconductive receptor and is shown in aforesaid general formula [B] is a photoconductive substance which itself senses ultraviolet rays and generates carriers and the carriers generated by the ultraviolet rays neutralize the positive holes trapped in the layer containing carrier transport substance and thereby improve the carrier transport efficiency. When aforesaid styryl compound alone is used as a carrier transport substance, the acceptance potential tends to drop due to the repeated usage and therefore it is difficult to maintain the stable performance. If amine derivative shown in aforesaid general formula [A] alone is used, deterioration takes place due to the deteriorating factors such as active substance having oxidization action caused by ultraviolet rays and corona discharge and the transport function drops in the course of the repeated usage, which is a drawback.

Namely, the sufficient effect of the present invention may be displayed by the photosensitive layer containing, as a carrier transport substance, the combination of amine derivative shown in aforesaid general formula [A] and styryl compound shown in aforesaid general formula [B].

The present invention has been described referring to the concrete constitution examples shown in FIG. 1 and FIG. 2 and in the present invention, it is enough that aforementioned constituent components are contained as a carrier transport layer to be combined with a carrier generating layer and a mechanical constitution as a photosensitive receptor for electrophotography may freely be selected.

Figure 3:
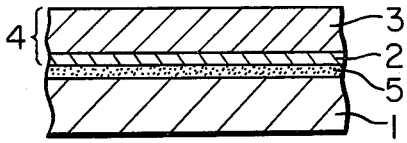
FIGS. 3 and 4 are the illustrative enlarged sectional views respectively showing the still other construction examples of the photoconductive receptor of the present invention.

For example, as shown in FIG. 3, an appropriate interlayer 5 may be arranged on the conductive support 1 and the carrier generating layer 2 may be formed thereon and the carrier transport layer 3 may be formed on the carrier generating layer 2. It is possible to cause this interlayer 5 to have the function to prevent free carriers to be injected into the photosensitive layer 4 from the conductive support 1 when charging the photosensitive layer 4 and the function as an adhesive layer that attach the photosensitive layer 4 to the conductive support 1 solidly. As a material of such interlayer 5, a metallic oxide such as aluminum oxide and indium oxide etc. and a high molecular substance such as acrylic resin, methacrylic resin, polyvinyl chloride resin, vinyl acetate resin, epoxy resin, polyurethane resin, phenol resin, polyester resin, alkyd resin, polycarbonate resin, silicone resin, melamine resin, vinyl chloride/vinyl acetate copolymer resin, vinyl chloride/vinyl acetate/-maleic anhydride copolymer resin etc. can be used.

Figure 4:
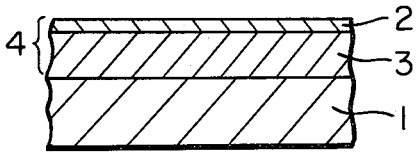

As shown in FIG. 4, the photosensitive layer 4 may be constituted by forming the carrier transport layer 3 on the conductive support 1 with or without aforesaid interlayer 5 as a medium and by forming the carrier generating layer 2 thereon.

The examples of the invention will be described hereinafter and it is however to be understood that the invention shall not be limited thereto.

EXAMPLE 1

On an electroconductive support comprising polyethylene terephthalate of 100 microns in thickness vacuum-evaporated with aluminium, an interlayer of approximately 0.1 micron in thickness comprising vinyl chloride-vinyl acetate-maleic anhydride copolyer, "S-lec MF-10" (mfd. by Sekisui Chemical Industry Co., Ltd.) was provided, and on the interlayer a carrier generating layer of approximately 0.5 microns in thickness was formed in the manner that 4,10-dibromanthanthrone, namely, Monolite Red 2Y - C.I. No. 59300, that is, a heterocyclic quinone dye, was vacuum-evaporated in a vacuum atmosphere of $2\text{–}3\times10^{-4}$ Torr at the temperature of 350° C. of an evaporation source for three minutes.

On the other hand, the amine derivative of 10.5 g indicated in (A-9), 4.5 g of the styryl compound exemplified in (B-18) and 15 g of polycarbonate resin i.e., "Panlite L-1250" (mfd. by Teijin Kasei K.K.) were dissolved in 100 ml of 1,2-dichloroethane, and the solution thus obtained was coated over to the carrier generating layer by using a doctor blade and was dried up at 80° C. for one hour to form a carrier transport layer of 12 microns in thickness, and thus an electrophotosensitive receptor of the invention, i.e., Sample No. 1, was prepared.

EXAMPLE 2

An electrophotosensitive receptor of the invention, i.e., Sample No. 2, was operated by forming a carrier generating layer of approximately 0.5 microns in thickness and a carrier transport layer of approx, 12 microns in thickness, in the same manner as that taken in Example 1 except that the exemplified compound, i.e., A-8 was used to serve in this case as an amine derivative.

EXAMPLE 3

An electrophotosensitive receptor of the invention, i.e., Sample No. 3, was prepared by forming a carrier generating layer of approximately 0.5 microns in thickness and a carrier transport layer of approx. 12 microns in thickness, in the same manner as that taken in Example 1 except that the exemplified compound, i.e., B-21 was used to serve in this case as a styryl compound.

EXAMPLE 4

An ultrasonic wave dispersion was made by adding 4 g of 4,10-dibromanthoanthrone into the solution prepared by dissolving 2 g of polycarbonate resin and 0.2 g of tetrabromophthalic anhydride in 100 ml of 1,2-dichlorethane, and the dispersion solution thus prepared was coated over to a conductive support having an interlayer that is similar support as that used in Example 1, and thus, a carrier generating layer of 1 micron in thickness was formed.

On the other hand, the dissolution of 10.5 g of the exemplified derivative, A-9, 4.5 g of the exemplified styryl compound, B-18, 0.03 g of tetrabromophthalic anhydride and 15 g of polycarbonate resin was made in 100 ml of 1,2-dichlorethane, and the solution thus obtained was coated over to the aforementioned carrier generating layer by means of a doctor blade and was then dried at 80° C. for one hour in order to form a carrier transport layer of 12 microns in thickness, and thus, an electrophotosensitive receptor of the invention, i.e., Sample No. 4, was formed.

EXAMPLE 5

An electrophotosensitive receptor of the invention, i.e., Sample 5, was prepared by forming a carrier generating layer of approx. 0.5 microns in thickness and a carrier transport layer of 12 microns in thickness in the same manner as that taken in Example 1 except that N,N'-dimethylperylene-3,4,9,10-tetracarboxylic acid diimide, that is, a perylene dye, namely, Paliogen maroon 3920, C.I. No. 71130, in place of a heterocyclic quinone dye used in Example 1.

EXAMPLE 6

On a conductive support comprising an aluminium-evaporated polyethyleneterephthalate of 100 microns in thickness, there was formed a carrier generating layer comprising amorphous selenium of 1 micron in thickness by vacuum evaporating selenium in a vacuum atmosphere at $2\text{-}3\times10^{-5}$ Torr for one minute at 300° C. at the evaporation source.

Next, a carrier transport layer of 12 microns in thickness was formed by coating thereon with the same carrier transport layer forming solution as that used in Example 1 and was then vacuum-dried at 40° C. for 24 hours, and thus an electrophotosensitive receptor, i.e., Sample No. 6, was formed.

CONTROL EXAMPLE 1

There was prepared a carrier transport layer forming solution without containing any styryl compound formulized in the Formula [B], by dissolving 15 g of the exemplified amine derivative, i.e., A-9, and 15 g of polycarbonate resin in 100 ml of 1,2-dichlorethane. The solution thus prepared was coated over to the same carrier generating layer as that used in Example 1 to form thereon a carrier transport layer of 12 microns in thickness, and thus, the electrophotosensitive receptor for control use, i.e., Control Sample No. 1, was formed.

CONTROL EXAMPLE 2

A carrier transport layer forming solution without containing any amine derivative was prepared by adding 15 g of the exemplified styryl compound, i.e., B-18 and 15 g of polycarbonate resin into 100 ml of 1,2-dichlorethane.

The solution thus prepared was coated over to the same carrier generating layer as that used in Example 1 to form a carrier transport layer of 12 microns in thickness, and thus, an electrophotosensitive receptor for control use, i.e., Control Sample No. 2, was formed.

CONTROL EXAMPLE 3

A carrier transport layer of 12 microns in thickness was formed in the same manner as that taken in Control Example 1 except that, in this case, 0.3 g of 2,4,7-trinitro-9-fluorenone was further added in the preparation of the same carrier transport layer forming solution as that used in Control Example 1, and thus, an electrophotosensitive receptor for control use, i.e., Control Sample No. 3, was formed.

The Samples No. 1–6 and the Control Samples No. 1–3 were tried on Electrometer-SP-428 (mfd. by Kawaguchi Denki Seisaku-sho K.K.) to measure each of the charged potential Vo(V) on the surface of the photosensitive layer at the time immediately after the charging operation for five seconds at the applied voltage of −6KV and each of the amounts of illuminating light necessary for attenuating by half, $E_{\frac{1}{2}}$ (1×. sec.). The results thereof is shown in Table 1.

TABLE 1

| Electrophotosensitive receptor | | Vo(V) | $E_{\frac{1}{2}}$ (1x. sec) | Thickness (μ) of carrier transport layer |
|---|---|---|---|---|
| Sample | No. 1 | −905 | 2.4 | 12 |
| | No. 2 | −895 | 2.7 | 12 |
| | No. 3 | −860 | 2.4 | 12 |
| | No. 4 | −745 | 2.6 | 12 |
| | No. 5 | −750 | 4.1 | 12 |
| | No. 6 | −980 | 7.9 | 12 |
| Control Sample | No. 1 | −760 | 2.8 | 12 |
| | No. 2 | −750 | 2.4 | 12 |
| | No. 3 | −745 | 3.0 | 12 |

Also, in the similar measuring method, each of the amounts of illuminating light necessary for attenuating the surface potential of each photosensitive layer from −500(V) to −50(V), that is, $E_{50}^{500}$ (1×. sec.).

Next, in order to investigate the stability of each sample to ultraviolet ray of light, each of Sample No. 1 and Control Samples No. 1–3 were irradiated by the light of an extra-high pressure mercury lamp, SHL-100 UV, mfd, by Toshiba, from the distance of 5 cm for 30 seconds and were measured for the values of $E_{50}^{500}$ in the similar manner. The results thereof are shown in Table 2.

TABLE 2

| Electrophotosensitive receptor | $E_{50}^{500}$ (1x. sec) | $E_{50}^{500}$ (1x. sec) after irradiating UV |
|---|---|---|
| Sample No. 1 | 5.6 | 5.6 |
| Control Sample No. 1 | 6.2 | 9.1 |
| Control Sample No. 2 | 5.8 | 5.6 |
| Control | 6.5 | 9.0 |

TABLE 2-continued

| Electrophoto-sensitive receptor | $E_{50}^{500}$ (1x. sec) | $E_{50}^{500}$ (1x. sec) after irradiating UV |
|---|---|---|
| Sample No. 3 | | |

The aforementioned Samples No. 1–6 and Control Samples No. 1–3 were respectively put onto a dye type electronic copying machine, U-Bix 2000R, (mfd. Konishiroku Photo Industry Co.) to carry out the continuous copying operation, and each of the black-paper potentials Vb(V) and the white-paper potentials Vw(V) at the exposure aperture of 2.5 was measured just before the developments, by means of an electrostatic volt meter, 144D-1D (mfd. by Monroe Electronics Inc.). The results thereof are shown in Table 3.

Wherein, a black-paper potential mean the surface potential of a photosensitive receptor, obtained when a black-paper of the reflection density of 1.3 is used as an original and the abovementioned copy cycle is then carried out, and a white-paper potential mean the surface potential of a photosensitive receptor, obtained when a white-paper is used as an original.

| Electrophoto-sensitive receptor | | Image Potential (V) | | |
|---|---|---|---|---|
| | | Initial stage | After 5,000 copying | Amount of variation |
| Sample | No. 1 | −685 | −655 | ⊖30 |
| | | (−10) | (−10) | (0) |
| | No. 2 | −660 | −645 | ⊖15 |
| | | (−20) | (−20) | (0) |
| | No. 3 | −645 | −605 | ⊖40 |
| | | (−15) | (−10) | (⊖5) |
| | No. 4 | −535 | −500 | ⊖35 |
| | | (−15) | (−15) | (0) |
| | No. 5 | −535 | −515 | ⊖20 |
| | | (−45) | (−40) | (⊖5) |
| | No. 6 | −730 | −685 | ⊖45 |
| | | (−190) | (−180) | (⊖10) |
| Control Sample | No. 1 | −600 | −730 | ⊕130 |
| | | (−20) | (−185) | (⊕165) |
| | No. 2 | −570 | −320 | ⊖250 |
| | | (−20) | (−10) | (⊖10) |
| | No. 3 | −575 | −695 | ⊕120 |
| | | (−20) | (−170) | (⊕150) |

Wherein, the upper figures indicate the black-paper potentials Vb(V), the lower figures parenthesized indicate the white-paper potentials Vw(V), and the amounts of variation indicate the increases by ⊕ and the decrease by ⊖ mark.

It may be understood from the results shown in Table 3 that the black-paper potential and the white-paper potential of every Sample receptor are more stable and less in the variation thereof after 5,000 copying as compared with those obtained at the initial stage, while both of the potentials of Control Samples No. 1 and No. 3 were raised sharply, and inter alia they cause the grey-background on the copy images because of the raised white-paper potential and Control Sample No. 2 was seriously lowered in the image density because the black-paper potential was lowered.

What is claimed is:

1. In a photoconductive receptor for use in electrophotography, said receptor being provided on a conductive support and having a photoconductive layer, said photoconductive layer comprising a carrier generating layer and a carrier transport layer, said carrier transport layer comprising an amine derivative represented by formula (A) and at least 1% by weight of a styryl compound represented by formula (B), based on the total weight of said amine derivative and said styryl compound;

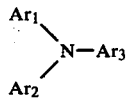

Formula [A]

wherein, $Ar_1$ and $Ar_2$ each represent a phenyl group or a substituted phenyl group, said substituted phenyl group having at least one substituent selected from the group consisting of a halogen atom, an alkyl group, a nitro group and an alkoxy group; and $Ar_3$ is selected from the group consisting of a phenyl group, a naphthyl group, an anthryl group, a fluorenyl group, and a 5–7 membered heterocyclic ring, wherein said groups and said heterocyclic ring may be substituted with at least one substituent selected from the group consisting of a halogen atom, an alkyl group, a hydroxy group, an alkoxy group, an aryloxy group, a nitro group, a piperidino group, a morpholino group, a naphthyl group, an anthryl group and an amino group, said amino group may be substituted with at least one substituent selected from the group consisting of an acyl group, an alkyl group, an aryl group and an aralkyl group;

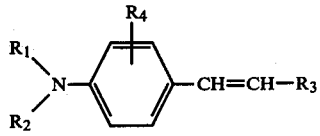

Formula [B]

wherein, $R_1$ and $R_2$ are each selected from the group consisting of an alkyl group, a substituted alkyl group, a phenyl group and a substituted phenyl group, wherein said substituted alkyl group and said substituted phenyl group have at least one substituent selected from the group consisting of an alkyl group, an alkoxy group and a phenyl group; $R_3$ is selected from the group consisting of a phenyl group, a naphthyl group, an anthryl group, a fluorenyl group and a carbazolyl group, wherein said $R^3$ groups may have at least one substituent selected from the group consisting of a halogen atom, a hydroxy group, an alkyl group, an alkoxy group and a phenyl group; and $R_4$ is selected from the group consisting of a hydrogen atom, a halogen atom, an alkyl group, an alkoxy group, a mono-alkyl amino group and a di-alkyl amino group.

2. The photoconductive receptor of claim 1, wherein said styryl compound is present in an amount of 1 to 80% by weight.

3. The photoconductive receptor of claim 2, wherein said styryl compound is present in an amount of 5 to 50% by weight.

4. The photoconductive receptor of claim 2, wherein said heterocyclic ring of $Ar_3$ is a furyl group or a thienyl group.

5. The photoconductive receptor of claim 1, wherein said amine derivative and said styryl compound are dispersed in a binder.

6. The photoconductive receptor of claim 5, wherein said binder is selected from the group consisting of a polyethylene, a polypropylene, a polyacrylate, a polymethacrylate, a poly-vinyl halide, a polyester, a polycarbonate, and epoxy resin, a phenolic resin, an alkyd resin, a silicone resin, a melamine resin, a vinyl chloride-vinyl acetate copolymer, a vinyl chloride-vinyl acetate-maleic anhydride copolymer and a poly-N-vinyl carbazole.

7. The photoconductive receptor of claim 1, wherein said carrier generating layer is on said conductive support, and said carrier transport layer is on said carrier generating layer.

8. The photoconductive receptor of claim 1, wherein said carrier transport layer is on said conductive support, and said carrier generating layer is on said carrier transport layer.

9. The photoconductive receptor of claim 1, 7 or 8, wherein said conductive support comprises insulating substrate and a conductive layer thereon.

10. The photoconductive receptor of claim 9, wherein said insulating substrate is a polyether.

11. The photoconductive receptor of claim 9, wherein said conductive layer is aluminium.

12. The photoconductive receptor of claim 1, wherein said heterocyclic ring $Ar_3$ is a furyl group or a thienyl group.

13. The photoconductive receptor of claim 1, wherein at least one of said layers further comprises an electron receptive substance.

14. The photoconductive receptor of claim 1, wherein said receptor further comprises an intermediate layer between the conductive support and the photoconductive layer.

* * * * *